United States Patent [19]

Steffen

[11] 4,292,899

[45] Oct. 6, 1981

[54] PROTECTIVE ELEMENT FOR FORK-LIFT PALLETS

[76] Inventor: Vincent B. Steffen, 321 E. Hamilton, New Hampton, Iowa 50659

[21] Appl. No.: 941,189

[22] Filed: Sep. 11, 1978

[51] Int. Cl.[3] ..... B65D 19/38

[52] U.S. Cl. ..... 108/51.1; 108/57.1

[58] Field of Search ..... 108/57.1, 51.1; 206/386; 217/43 A

[56] References Cited

U.S. PATENT DOCUMENTS

| | | | |
|---|---|---|---|
| 2,651,486 | 9/1953 | Woodward | 108/57.1 |
| 2,817,485 | 12/1957 | White et al. | 108/57.1 |
| 2,823,883 | 2/1958 | Bourdon | 108/57.1 |

*Primary Examiner*—William E. Lyddane

*Attorney, Agent, or Firm*—Henderson & Sturm

[57] ABSTRACT

Disclosed here is a plate-like element, preferably of sheet metal, used in pairs, for affixation to the leading stringer of a fork-lift pallet to protect the stringer against damage by the fork-lift fork, each element being cut out to provide an opening for register with the fork tine-receiving opening in the stringer.

4 Claims, 4 Drawing Figures

PROTECTIVE ELEMENT FOR FORK-LIFT PALLETS

SUMMARY OF THE INVENTION

The use of fork-lifts and pallets for handling materials has been known for many years. A typical fork-lift is a self-propelled vehicle having at its front end a mast and hoist structure, at the lower end of which is a fork comprising a pair of horizontal, forwardly extending tines insertable beneath a load. The hoist, usually hydraulically powered, is used to raise the load and the fork-lift truck carries the load to an unloading point. Pallets are used for receiving the load initially so as to permit the handling of heavy and bulky loads or to enable the stacking of several articles to comprise the load. Normally the load and pallet are shipped as a unit.

A conventional pallet is a wooden structure made up of a plurality of parallel, horizontal stringers (usually three) and a plurality of cross boards, all nailed together to form a rectangular (usually square) element. The stringers may be typically $1\frac{3}{4}''$ (43.75 mm) thick by $3\frac{3}{4}''$ (93.75 mm) high so as to space the load above the floor. In so-called two-way pallets, the fork tines enter between the stringers and engage the cross boards from below. In the 4-way pallet, the stringers are cut out in two areas each to provide inverted U-shaped openings spaced apart to receive the fork. Thus, the fork may enter, selectively, from any of the four sides of the pallet, whereas in the 2-way pallet entry can occur from only two opposite sides. It is with the 4-way pallet that the present invention is concerned.

In one known fork-lift, each fork tine is approximately 40" (100 cm) long and 4" (10 cm) wide and the tines are spaced apart 36"–38" (90–95 cm) on centers. All pallets are not exactly alike but are dimensioned so as to accommodate most if not all fork-lifts. Thus, the fork entry openings are made wide enough to accommodate different tine spacings as well as to enable easy entry without precise maneuvering of the fork-lift. Nevertheless, it is not always easy for the fork-lift operator to see the entry openings and consequently the tips of the tines engage the stringers out of register with these openings, resulting ultimately in such severe damage to the stringers that they must be repaired, replaced or the pallet discarded, all of which leads to excessive cost and down-time.

The invention provides protection of the stringers in the areas of fork tine entry, specifically by plate-like elements here of generally rectangular construction, each being cut out to form an inverted U-shaped opening for substantial register with the selected stringer opening. Each plate is so dimensioned that it covers relatively large stringer areas to both sides of and above the stringer opening, thus increasing the protection afforded by the plate. Each plate has several holes or perforations to receive fasteners, usually nails, to secure the plate to the stringer. In the manufacture of each plate, primarily in the formation of the U-shaped opening, an integral lip is formed, which extends rearwardly from the upper edge of the opening and normal to the plane of the plate. This lip lies against or engages the underside of the stringer opening, thus increasing the protective effect of the plate. In addition, the lip serves as a locator for easy assembly of the plate to the stringer.

DETAILED DESCRIPTION

Figure 1:
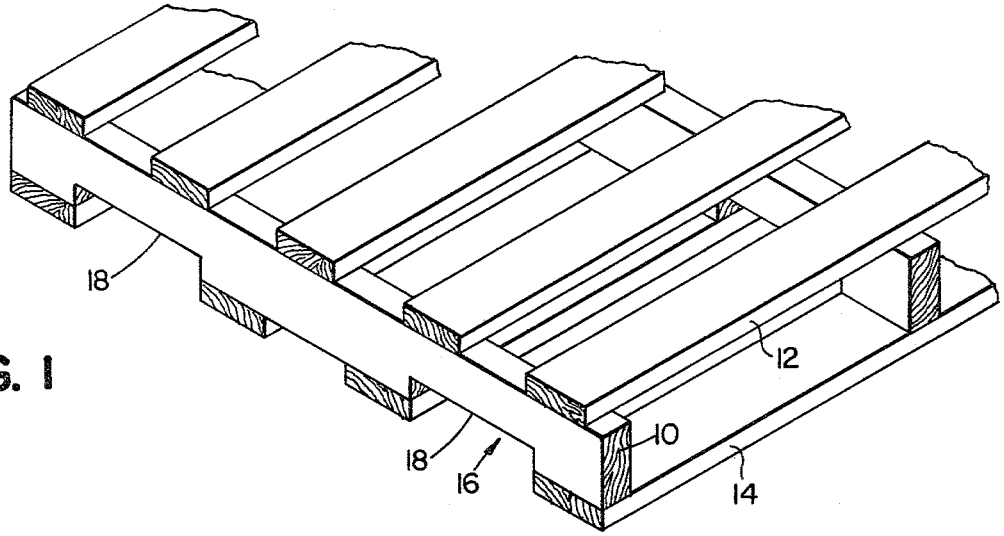
FIG. 1 is a fragmentary perspective of a typical pallet, showing particularly an outer stringer with its fork-receiving openings.
Figure 2:
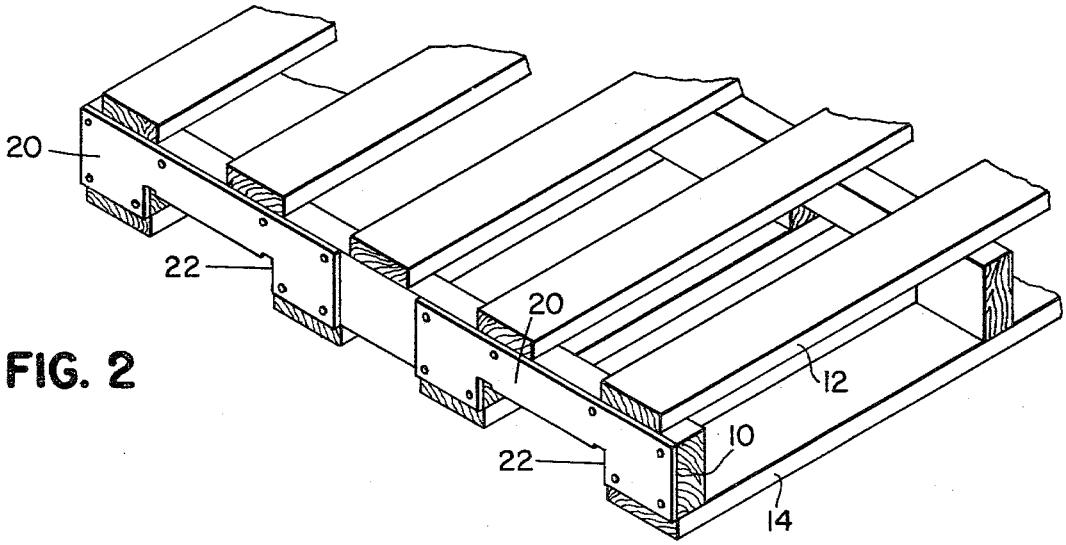
FIG. 2 is a like perspective, showing the stringer supplemented by a pair of protective plates.

In FIGS. 1 and 2, the numeral 10 denotes one foremost stringer, which is one of three, the other two not being shown, since they are identical to that shown at 10. The stringers are horizontal and parallel and are spaced apart on the order of 16"–18" (40–45 cm), which agrees with the fork lift tine spacing. The stringers are rigidly cross-connected by top and bottom boards 12 and 14, usually of 1" (25 mm) stock about 6" (150 mm) wide as required. When the pallet is entered by the fork lift from the sides, the tines enter between the stringers and engage beneath the top cross boards. In a 4-way pallet, which is shown here, fork lift entry is permitted from either end as well as from the sides, each stringer being cut out to provide a pair of inverted U-shaped openings 16. These are spaced apart and otherwise dimensioned to receive the fork tines. When the fork enters the openings, the tines engage beneath the upper portions of the openings 16, as at 18. Since stringer openings are alined, a pair of "tunnels" is formed within the pallet for receiving the fork.

As will be appreciated, the fork lift operator cannot always readily aline the fork with the openings 16 and thus the tips of the tines engage areas of the stringer bordering the opening, sometimes to either side of an opening and sometimes above the opening. It must be observed that the usual fork lift is a relatively powerful vehicle, often operated rapidly over day-long periods. Consequently the stringers are subjected to extreme forces, resulting in heavy damage, such as splintering, denting and just plain wear. In the past, stringers have been repaired, when possible, replaced, or the pallet is simply thrown away.

According to the present invention, this damage can be eliminated on new pallets, and used pallets can be reclaimed. Provided here is a plurality of plates, used in pairs, one pair at each end of the pallet and affixed to the outermost stringers at the fork tine entry areas. It is also possible to add plates to the inner faces of the end stringers, as well as to both faces of the center stringer.

Figure 3:
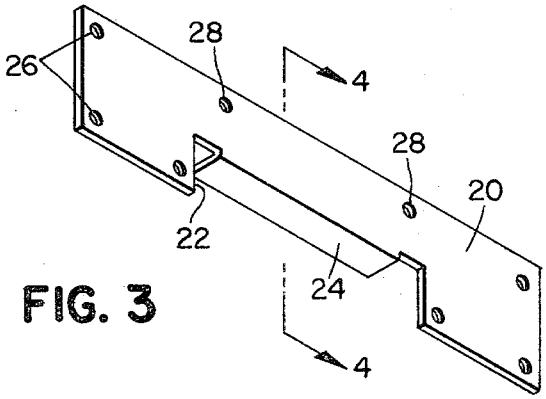
FIG. 3 is a perspective of a plate by itself.
Figure 4:
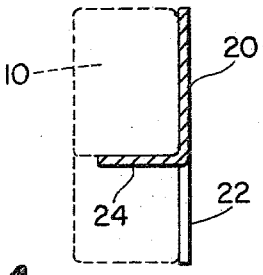
FIG. 4 is an enlarged section on the line 4—4 of FIG. 3, the stringer being shown in dotted lines.

FIG. 2 shows a pair of protective elements 20 affixed to the stringer 10. FIG. 3 shows one element, which is preferably a substantially rectangular plate of sheet metal, preferable about 20 gauge (0.041" or a little over 1 mm). The plate chosen for illustration here is 21" (52 cm) long and $3\frac{1}{2}''$ (87.5 mm) high. It is formed with a centered inverted U-shaped opening 22, the length of which is 10" (25 cm) and the height of which is $1\frac{1}{2}''$ (37 mm). In the formation of the plate, preferably by a stamping operation, a portion of the metal originally occurring in the area in which the opening 22 is formed, is bent backwardly to form an elongated integral lip 24. This lip lies normal to the plane of the plate. The plate is provided with perforations or holes 26 to receive fasteners for the affixation of each plate to the stringer 16. Nailing is the preferred method of attachment.

It will be seen that the length of the lip 24 is less than that of the plate opening 22. In the present instance, the lip has a length of 7" (17.5 cm) and extends rearwardly about 1½" (37 mm), just about the thickness of a stringer. The lip is centered on the opening 22 and, in use, engages the under portion of the stringer bordered the stringer opening 16. The purpose of the shorter length of the lip relative to the opening 22 will be brought out below.

Also to be noted is that at least two of the nail-receiving perforations or holes are located above the opening 22 and within the confines of the outer edges of the opening extended. These holes are designated 28. It has been found that nailing in this area prevents buckling of the plate in the area just above the opening 22.

The use and application of the plates will be apparent from the description preceding. To be added is the explanation of why the length of the lip is less than that of the opening 22. As explained above, not all pallets are alike, especially as to stringer opening dimensions. The shorter lip 24 accommodates variations, yet the total dimensions of the plate are sufficient to overlie substantial areas of the stringer at both sides of as well as above the stringer opening. Most fork lifts will have tines of about 4" (100 mm) in width, and the 7" (17.5 cm) length is sufficient to protect the stringer from below. The lip also serves as a locator for easy assembly of the plate to the pallet. The plates are preferably galvanized or otherwise treated, and this makes a smoother surface to enable the fork lift operator to more easily locate the entry openings. Further, the metal plates better lend themselves to identification by stamping or otherwise, as for use in computerized palleting.

The many advantages of the plates include installation on new pallets, reclaiming older pallets, preventing damage, safety because of added strength and the elimination of splintering and low cost with virtually no maintenance. In brief, since stringers are the "backbone" of the pallet, and saving the stringers means saving the pallet.

I claim:

1. For use with a fork-lift pallet having an elongated, horizontal wooden stringer provided with an inverted U-shaped opening affording entry of a tine of a fork-lift truck, a protective element comprising:

a generally rectangular plate having an inverted U-shaped opening for substantial register with the stringer opening, said plate having such length and height as to protectively overlie the front face of the stringer to both sides of and above the stringer opening, said plate opening affording entry of the fork-lift truck tine to the stringer opening while the remainder of the plate protects the front face of the stringer from damage by the tine, said plate provided with perforations to receive fasteners for affixation of the plate to the stringer, at least two of which said perforations lie above and within the confines of the ends of the plate opening extended, in order to reinforce the narrow portion of the plate and stringer against buckling and a lip integral with the plate and extending rearwardly from the upper edge of the plate opening so as to engage and underlie that portion of the stringer opening along the upper edge of the stringer opening, wherein the length of the lip is spaced an appreciable distance from the edges of the plate opening and is substantially centered therein.

2. For use with a fork lift pallet having an elongated, horizontal wooden stringer provided with at least two inverted U-shaped openings affording entry of tines of a fork-lift truck: at least two protective elements, each comprising a generally rectangular plate attachable to the front face of the stringer and each itself having an inverted U-shaped opening for substantial register with each stringer opening, said plates having such length and height to protectively overlie the front face of the stringer to both sides of and above each stringer opening, said plate openings affording entry to the stringer openings while the remainder of the plate protects the front face of the stringer from damage by the tine receive fasteners for affixation of the plates to the stringer, at least two of which said perforations lie above and within the ends of each plate opening extended, in order to reinforce the narrow portion of the plate and stringer against buckling.

3. The elements of claim 2 including lips integral with the plates and extending rearwardly from the upper edges of the plate openings so as to engage and underlie that portion of the stringer openings along the upper edges of the stringer openings, wherein the length of the lips is spaced an appreciable distance from the edges of the plate openings.

4. The elements of claim 3 in which the lips are substantially centered on the plate openings.

* * * * *